US012114822B2

(12) United States Patent
Woodhead et al.

(10) Patent No.: US 12,114,822 B2
(45) Date of Patent: Oct. 15, 2024

(54) CHEMICAL DOSING SYSTEM

(71) Applicant: Selden Research Ltd., Buxton (GB)

(72) Inventors: Peter Woodhead, Buxton (GB); Terry Holland, Buxton (GB); Ian Morris, Buxton (GB)

(73) Assignee: Selden Research Ltd., Buxton (GB)

( * ) Notice: Subject to any disclaimer, the term of this patent is extended or adjusted under 35 U.S.C. 154(b) by 0 days.

(21) Appl. No.: 17/689,767

(22) Filed: Mar. 8, 2022

(65) Prior Publication Data

US 2022/0183533 A1 Jun. 16, 2022

Related U.S. Application Data

(63) Continuation of application No. 16/758,772, filed as application No. PCT/GB2018/053057 on Oct. 23, 2018, now Pat. No. 11,291,347.

(30) Foreign Application Priority Data

Oct. 23, 2017 (GB) ..... 1717383

(51) Int. Cl.
*A47L 15/00* (2006.01)
*A47L 15/42* (2006.01)
(Continued)

(52) U.S. Cl.
CPC ..... *A47L 15/0055* (2013.01); *A47L 15/0047* (2013.01); *A47L 15/0057* (2013.01);
(Continued)

(58) Field of Classification Search
CPC ..... A47L 15/44–449; A47L 15/00–508; A47L 2401/14; A47L 2501/07; A47L 2401/06; A47L 15/0055
See application file for complete search history.

(56) References Cited

U.S. PATENT DOCUMENTS 4,932,227 A 6/1990 Hogrefe
4,981,024 A 1/1991 Beldham
(Continued)

FOREIGN PATENT DOCUMENTS

CN 106988076 A 7/2017
DE 102004030013 A1 1/2006
(Continued)

OTHER PUBLICATIONS

Non-Final Office Action for U.S. Appl. No. 16/758,772, mailed Jun. 30, 2021, 9 pages.
(Continued)

*Primary Examiner* — Spencer E. Bell
(74) *Attorney, Agent, or Firm* — Withrow + Terranova, PLLC; Vincent K. Gustafson

(57) ABSTRACT

Disclosed herein is a chemical dosing system for an appliance, such as a laundry washing machine or a dishwashing machine, having a water inlet, the system comprising a meter for determining the volume of water supplied to the appliance, a pump for dispensing a quantity of a chemical to the appliance and a control unit arranged to receive a signal from the meter and to cause to be dispensed to the appliance a volume of chemical that is proportional to the quantity of water supplied to the appliance. The disclosed system may enable a correct quantity of chemical to be automatically dispensed to many types of appliance, without the need to know anything about the appliance, or to derive electrical signal from the appliance.

12 Claims, 2 Drawing Sheets

(51) Int. Cl.

| | |
|---|---|
| ***A47L 15/44*** | (2006.01) |
| ***D06F 33/37*** | (2020.01) |
| *D06F 33/72* | (2020.01) |
| *D06F 34/22* | (2020.01) |
| *D06F 39/02* | (2006.01) |
| *D06F 39/08* | (2006.01) |
| *D06F 101/00* | (2020.01) |
| *D06F 101/20* | (2020.01) |
| *D06F 103/00* | (2020.01) |
| *D06F 103/14* | (2020.01) |
| *D06F 103/18* | (2020.01) |
| *D06F 103/20* | (2020.01) |
| *D06F 103/22* | (2020.01) |
| *D06F 103/38* | (2020.01) |
| *D06F 103/68* | (2020.01) |
| *D06F 103/70* | (2020.01) |
| *D06F 105/42* | (2020.01) |
| *D06F 105/58* | (2020.01) |

(52) U.S. Cl.

CPC ..... *A47L 15/4229* (2013.01); *A47L 15/4297* (2013.01); *A47L 15/4454* (2013.01); *A47L 15/449* (2013.01); *D06F 33/37* (2020.02); *A47L 2301/04* (2013.01); *A47L 2301/06* (2013.01); *A47L 2401/026* (2013.01); *A47L 2401/11* (2013.01); *A47L 2401/14* (2013.01); *A47L 2401/20* (2013.01); *A47L 2401/22* (2013.01); *A47L 2501/07* (2013.01); *D06F 33/72* (2020.02); *D06F 34/22* (2020.02); *D06F 39/022* (2013.01); *D06F 39/087* (2013.01); *D06F 2101/00* (2020.02); *D06F 2101/20* (2020.02); *D06F 2103/00* (2020.02); *D06F 2103/14* (2020.02); *D06F 2103/18* (2020.02); *D06F 2103/20* (2020.02); *D06F 2103/22* (2020.02); *D06F 2103/38* (2020.02); *D06F 2103/68* (2020.02); *D06F 2103/70* (2020.02); *D06F 2105/42* (2020.02); *D06F 2105/58* (2020.02)

(56) References Cited

U.S. PATENT DOCUMENTS

| | | | | |
|---|---|---|---|---|
| 5,056,542 | A | 10/1991 | Reinhard | |
| 5,282,901 | A * | 2/1994 | Reinhard | A47L 15/449 222/651 |
| 2006/0081016 | A1 | 4/2006 | Hsu et al. | |
| 2006/0107705 | A1 | 5/2006 | Hsu et al. | |
| 2006/0216217 | A1 | 9/2006 | Chan et al. | |
| 2007/0044819 | A1 | 3/2007 | Chan et al. | |
| 2009/0194562 | A1* | 8/2009 | Kessler | D06F 39/022 222/63 |
| 2010/0175718 | A1* | 7/2010 | Kedjierski | A47L 15/4244 134/18 |
| 2011/0031272 | A1 | 2/2011 | Comiskey et al. | |
| 2013/0042652 | A1 | 2/2013 | Brueckner et al. | |
| 2013/0086754 | A1 | 4/2013 | Hendrickson et al. | |
| 2014/0053875 | A1* | 2/2014 | Anim-Mensah | A47L 15/4297 134/22.18 |
| 2014/0277751 | A1 | 9/2014 | Fulmer et al. | |
| 2014/0283561 | A1 | 9/2014 | McKenna et al. | |
| 2015/0059809 | A1* | 3/2015 | Petri | B65D 41/02 215/316 |
| 2016/0051121 | A1* | 2/2016 | Brignone | A47L 15/4229 134/57 D |
| 2017/0037558 | A1 | 9/2017 | Dunsbergen et al. | |
| 2018/0146835 | A1* | 5/2018 | Alexander | A47L 15/0063 |
| 2018/0148881 | A1 | 5/2018 | Alexander et al. | |
| 2020/0255998 | A1 | 8/2020 | Woodhead et al. | |

FOREIGN PATENT DOCUMENTS

| | | | |
|---|---|---|---|
| EP | 0633342 | A1 | 1/1995 |
| EP | 1318225 | A1 | 6/2003 |
| EP | 1582135 | A1 | 10/2005 |
| EP | 1746151 | A1 | 1/2007 |
| EP | 2433547 | A2 | 3/2012 |
| EP | 2982793 | A1 | 2/2016 |
| GB | 2051413 | A | 1/1981 |
| WO | 2018133620 | A1 | 7/2018 |

OTHER PUBLICATIONS

Notice of Allowance for U.S. Appl. No. 16/758,772, mailed Dec. 15, 2021, 10 pages.

Combined Search and Examination Report for United Kingdom Patent Application No. GB1817236.1, mailed Mar. 25, 2019, 9 pages.

Search Report under Section 17(5) for United Kingdom Patent Application No. GB1817236.1, mailed Apr. 13, 2018, 5 pages.

Search Report under Section 17(5) for United Kingdom Patent Application No. GB2011986.3, mailed Oct. 16, 2020, 7 pages.

International Search Report for International Application No. PCT/GB2018/053057 {Form PCT/ISA/210), mailed Mar. 7, 2019, 7 pages.

Written Opinion for International Application No. PCT/GB2018/053057 {Form PCT/ISA/237), mailed Mar. 7, 2019, 13 pages.

* cited by examiner

CHEMICAL DOSING SYSTEM

STATEMENT OF RELATED APPLICATIONS

This application is a continuation of U.S. patent application Ser. No. 16/758,772 filed on Apr. 23, 2020, and subsequently issued as U.S. Pat. No. 11,291,347, which is a 35 U.S.C. § 371 national phase filing of International Application No. PCT/GB2018/053057 filed on Oct. 23, 2018, and claims the benefit of United Kingdom Patent Application No. 1717383.2 filed on Oct. 23, 2017, wherein the entire disclosures of the foregoing applications and patent are hereby incorporated by reference herein.

TECHNICAL FIELD

The present invention relates to a chemical dosing system, for providing a chemical or chemicals to an appliance having a water inlet and particularly, but not exclusively, to a dosing system for a commercial dishwashing or laundry washing machine.

BACKGROUND

Commercial (also known as professional) dishwashing machines can be known by several terms depending on the scale and local terminology. For clarity, the terms 'dishwashing machine' and 'dishwasher' in this invention can refer to warewashing, warewasher, glasswashing, glasswasher, rack conveyor, tunnel dishwasher, flight machine.

Whilst the invention can be utilised in different ways for different applications it is important to understand the fundamental differences between the different machines used for the purposes of cleaning inside a machine.

Domestic dishwashers and laundry machines both have inlets, primarily for cold water but sometimes they have an additional hot water inlet. Both have cycle times normally in the region of 1-2 hours. Both drain their water completely after each wash. Both have a manual addition of detergent for each cycle.

A commercial laundry machine is substantially larger. Typically, a domestic machine handles up to 5 kg of laundry per cycle, a commercial laundry machine is in the range of 12-200 kg. Even larger machines are available in a slightly different design known as Barrier washers and tunnel washers, which are commonly used for laundering hotel bed linen and hospitals. In a domestic or <200 kg commercial machine the laundry occupies a container/drum in the machine through which the pre-wash, main wash and rinse cycles all take place. In a tunnel washer the laundry passes through a large machine by use of a conveyor whereby the various stages of the cycle: pre-wash, main wash and rinse take place in different compartments of the machine. A barrier washer has a wall between dirty and clean washing with two doors operated at each side of the wall. Commercial machines tend to have much shorter cycle times than domestic machines, often in the region of 30-60 minutes, unlike domestic machines which can have extended programmes. In both types of machine the weight of laundry in the machine is greatly exceeded by the quantity of water in the machine.

Typically, a 20 kg machine will use 80 litres of water at each part of the cycle. Given that a typical cycle contains separate steps for pre-wash, main wash and 3 separate rinses then the machine will be filled with 80 litres of water a total of 5 times, i.e. it will consume 400 litres of water during the wash.

The difference in size of the laundry machines lead to a couple of different requirements specific to commercial machines. Firstly, the water supply. In the above example of a 20 kg machine requiring 400 litres for a full cycle then out of the 1 hour wash cycle in the region of 10 minutes could be spent simply filling the machine with water. For this reason, commercial machines tend to have multiple water inlets.

Secondly, detergent and fabric conditioner are generally dosed into the machine at the ratio of 10 ml per kg of laundry. Once machines become greater than 20 kg it becomes increasingly impractical to add this quantity of detergent by hand so external dosing systems are used which can respond to the various programmes used by the machine e.g. hot wash or gentle wash, and dose the correct quantity of detergent at the correct part of the cycle.

Thirdly, because the detergent is dosed by a separate dosing system, it is possible to add a number of different components into the wash which would normally be incompatible in one product. For example, a destainer can be dosed into the machine at the same time as the detergent.

Fourthly, as the chemistry and dosing rates are unique to each detergent supplier it is in practice the responsibility of the detergent supplier to install a pump correctly set up to deliver the necessary quantity of detergent, fabric conditioner and other additives at the correct part of each cycle. Since the required quantities of detergent, fabric conditioner and other additives are related not just to the chemistry of those products but also to the size of the machine and the type of laundry the engineer responsible for installing the pump needs to have knowledge of both the desired dosing ratios and the size of the machine to set the dosing pump up correctly.

For dishwashers, the differences between domestic and commercial are starker. A domestic machine cycle takes in the region of a couple of hours to complete a cycle, whereas a commercial machine takes a couple of minutes. This reduction in cycle time by a factor of approximately 60 leads to a substantial number of practical differences.

Like commercial laundry machines, commercial dishwashing machines also come in a wide variety of sizes, from an under-counter glasswasher used to clean glasses in a bar, to a rack conveyor used in a school which works by having the dishes racked on a conveyor belt passing through the different compartments in the large machine for pre-wash, main wash and rinse.

The varying demands are as follows: firstly, to complete the wash cycle and also get the crockery/glassware reasonably dry within a couple of minutes the commercial machines require different detergents and rinse aids and a large amount of instant hot water.

Secondly, this requirement for instant hot water, potentially for a new tray of crockery every few minutes, leads to a fundamentally different design for commercial machines—the spent water is recycled. For a typical small dishwashing machine the machine might consume 2.5 litres of fresh water per wash but contain a reservoir of dirty water of approximately 10 litres. The reservoir of dirty water is used for cleaning whilst the 2.5 litres of fresh water is used for rinsing. This set up allows the machine to save water—each portion of water is used for roughly 1 rinse cycle and 4 wash cycles, but crucially the heat from the rinse water is not lost, it is used to provide cleaning performance in the cleaning cycle.

Thirdly, this short hot wash using recycled water brings a number of performance requirements which are unique to commercial machines. The detergents tend to be more aggressive to clean in such a short time. But they also need to be excellent at suspending soil to allow the water to be re-used. They must also dissolve extremely quickly, so in practice they are liquids which are dosed directly into the machine—a domestic style tablet simply wouldn't dissolve in time to produce the required cleaning. Fourthly, having such aggressive liquids dosed directly into the machine every few minutes is not a task which is practical to do by hand. The user needs to be kept away from these products, both for safety and to ensure accurate dosing, so in practice these products are normally dosed by a dedicated dosing pump installed by the detergent supplier. The required dose is set in accordance with the detergent manufacturer's recommended concentration and at the correct rate for the size of the machine. This requires the engineer to have knowledge of both the product and the machine to set the dosing pump up correctly.

Commercial dishwashing machines and laundry machines also have additional differences. The vastly shorter contact times of the dishwashing machines means that they are more reliant on heat and pressure from the washer jets to provide the cleaning performance. As mentioned above, the heat in the dishwashing machines is at least in part provided by the hot water (typically 82 oC) delivered in the rinse cycle. Such hot rinses are intended to leave the crockery dry on completion of the cycle. This requires the rinse aid to be delivered directly into the hot water boiler, separate from the detergent tank which has its own chemical inlet, whereas the laundry machine doses all the chemicals into the drum. The pressure from the washer jets is particularly important in the cleaning process and these are susceptible to becoming blocked with limescale if the products are dosed incorrectly.

Commercial dishwashing machines control much of the limescale by incorporating a water softening unit, which must periodically consume water under a regeneration cycle. Therefore, not all the water fed into the machine is used for cleaning, occasionally the machine will open the water inlet valve and divert the water to the water softening unit to regenerate the ion exchange water softener. High pressure jets also have the potential to create a lot of foam, which can leak out of the machine if not properly controlled by the correct selection of product and dose. Likewise, the correct dosage for the correct product is required to counter the high level of soiling in the water which is re-used approximately 4 times before being disposed of.

The re-use of old water can clearly only happen during regular operation during the day. At the start of the day the cleaning fluid reservoir must be filled for the day. In the above example, a charge of 10 litres of water including the required dose of detergent would be added to the tank when the machine is initially turned on. During a cleaning cycle this 10 litres would be refreshed with 2.5 litres of water coming from the rinsing operation, plus a dose of detergent appropriate for 2.5 litres of water, whilst a corresponding quantity of 2.5 litres of old water being discharged to drain. Therefore, the correct combination of products, identification of whether the machine is undergoing an initial charge, a regular wash or a water softener regeneration, combined with accurate dosage control is far more critical in commercial dishwashing than commercial laundry. Conversely, a commercial laundry machine will require much more water to perform the cleaning operation than the dishwashing machine. The larger size of the washing compartment of the machine, plus the requirement to fill the compartment 5 times, for the 2 washes and 3 rinse, plus the use of fresh water each time means the water supply into the machine is far more critical for a laundry machine. For this reason commercial laundry machines often have multiple water in-feeds so that a separate feed can supply each of the chemical inlets (pre-wash, main wash and fabric conditioner) and these can be utilised in combination with additional cold and/or hot water feeds to fill the washing chamber in the most efficient way.

The present invention is particularly applicable to commercial dishwashing machines of the above type (which includes glass washing machines and any other similar appliance) and commercial laundry washing machines. For this reason the present invention is described below with reference to such appliances only, but the invention is equally applicable to some other appliances and devices.

Chemicals, such as rinse aid, detergents or fabric conditioners, are often dispensed to commercial dishwashing and laundry washing machines by an automated mechanism, which controls both the timing and the quantity of chemical dispensed. This avoids operators having to learn, or look up, the appropriate doses and, in theory, this should avoid incorrect doses of such chemicals being added, or chemicals being omitted from a cycle. With an automated system, the dispensing of chemicals will often be controlled by a dosing unit, which will often be external to the appliance, with chemicals then being dispensed into the appliance by operation of peristaltic pumps, or similar, within the dosing unit, which are operated for a predetermined period of time in order to provide a required dose.

The predetermined period of time is normally set by an engineer, who may be employed by the company that installs the appliance, but who is more commonly employed by the chemical supplier, who will often provide and service the dosing unit. This may be provided free of charge, but be subject to that equipment being used only to dispense chemicals supplied by that supplier.

An engineer installing a chemical dosing unit, which may be proprietary to the chemical supplier, for use with a new or existing appliance, will normally also need to identify a number of circuits within the appliance, in order to make electrical connections to these and to subsequently derive signals from the appliance which can be used to appropriately control the operation of the dosing unit.

From the perspective of the chemical supplier, there are several issues which arise when providing a separate chemical dosing unit. A major one of these is that not all commercial dishwashing machines, or all commercial laundry washing machines, are the same. These are made by different manufacturers, many of which produce a number of models, which may be of different sizes. Thus, the quantity of a chemical to be dispensed and the circuitry within the machines, will be different for different machines.

As a result of the above, the burden on an engineer of the chemical supplier is relatively great, for if a chemical supplier wins a contract to supply chemicals for an appliance, an engineer will be required to visit the site to first ascertain, or confirm, the type of appliance in order to determine the volumes of chemical required for a particular cycle of that appliance and to set a controller of the dosing unit accordingly. They may also be required to determine the local water hardness, which may require dosses to be adjusted to take this into account. In addition, they will need to ascertain where on the appliance they can obtain an appropriate signal to trigger the dispensing of a chemical and then provide an appropriate electrical connection between the appliance and the dosing unit.

From the above, it will be appreciated that the installation of a dosing unit, even in respect of a single appliance, can be relatively time consuming, particularly as an engineer is unlikely to be a specialist on every appliance type. Not only does this have cost implications for the chemical supplier, but it may also hinder their ability to win a large contract to supply chemical to a company with many appliances, possibly of different types and possibly distributed over a region, (country) or several regions (countries), particularly where a relatively short transfer period from one supplier to another is stipulated.

In addition to the above, if an engineer incorrectly sets a dosing unit, either as a result of incorrectly determining the quantities of chemical required by an appliance in a particular mode, by not correctly checking the water hardness (or checking the water hardness and this subsequently changing), or by simply making a mistake setting up the dosing unit, this will result in poor performance or foaming. This is then likely to be attributed to the new chemicals being supplied and thus reflect badly on the chemical supplier. Alternatively, or in addition, the chemical supplier may then have to use more engineer time in order to rectify any such deficiency.

It is an object of the present invention to provide a dosing system that addresses some of the above issues.

SUMMARY

According to a first aspect of the present invention there is provided an external chemical dosing system arranged to be located external to an appliance having a water inlet, the system comprising:

a meter arranged to be located external to the appliance for determining the volume of water supplied, or the rate at which water is being supplied, to the appliance via the water inlet;

a pump or valve arranged to be located external to the appliance for dispensing a volume of chemical to the appliance; and a control unit arranged to be located external to the appliance, the control unit being arranged to receive a signal from the meter or another flow sensor arranged to be located external to the appliance and to determine from said signal the stage in a cycle the appliance is at and to control the pump or valve in dependence thereon, to cause the pump or valve to dispense a chemical to the appliance appropriate for the stage of the cycle the appliance is at and to control the quantity of chemical dispensed, in dependence on the volume of water supplied via the water inlet to the appliance at that stage of the cycle.

A chemical dosing system, in accordance with the first aspect of the present invention, enables determination the stage of a cycle of an appliance by monitoring only the water supply to the appliance. The correct quantity of chemical to be dispensed to the appliance, for that stage in a cycle, can then also be determined by monitoring only that same supply. This avoids the requirement to know anything about the appliance, for common to every appliance is that, for a certain volume of water drawn for a particular stage in a cycle, there will be required a certain quantity of chemical of a certain concentration. Thus, the chemical supplier may supply a common control unit which may be arranged to work with any number of appliance types. Furthermore, it enables an engineer to install the chemical dosing system in a similar manner, regardless of the type of appliance, requiring only that the water supply be located. This can then be used not only to determine the volume of water drawn by the appliance and thus the quantity of a chemical required, but this can also be used to determine the stage of a cycle the appliance is at and thus the appropriate time to add the chemical into the appliance.

The present invention avoids the need to use a specialist engineer to install chemical dosing systems, enabling a supplier to widely and swiftly roll out dosing systems, irrespective of territorial area. For example, if chemical dosing systems are to be installed in respect of appliances in a number of different countries, in which the chemical supplier may not have their own engineers, the invention may permit them to use local non-specialist engineers, or plumbers, to perform the necessary work.

Another significant advantage of the present invention is that it enables a dosing system to be installed without requiring access to the electrical circuits of an appliance, as no electrical signal needs be derived from within the appliance. This is especially the case on commercial laundry washing machines, for example, where there are normally a number of externally accessible preformed injection ports on the drum, through which chemicals can be injected directly into the drum. Similarly, on commercial dishwashing machines there will normally be a detergent inlet port on the wash tank and possibly a rinse aid inlet port on the boiler. In some circumstances it may be preferable to inject the rinse aid into the water supply externally of the appliance, depending on a number of factors including and not limited to the existence of such an inlet port, the accessibility of the boiler, the qualifications of the engineer and the local regulations governing the protection of the mains water supply from chemicals injected directly into a mains pipe. A major advantage of not requiring access into an appliance is that the integrity of the appliance is maintained, avoiding any possible warranty issues, which may otherwise deter an owner of an appliance from adopting a dosing system provided by a chemical supplier.

The chemical dosing system may be arranged to be located external to an appliance having a plurality of water inlets, the system comprising;

a plurality of flow sensors each arranged to be located external to an appliance and to be associated with a respective water inlet of the appliance, each flow sensor being arranged to determine when water is being supplied through a respective inlet; and at least one meter arranged to determine the volume of water supplied to the appliance through one or more of the inlets, or the rate at which water is being supplied to the appliance through one or more of the inlets, wherein the control unit is arranged to:

receive signals from each of the flow sensors and the at least one meter and to determine from said signals the stage in a cycle the appliance is at, by determining through which inlets water is being drawn into the appliance;

control the pump or valve in dependence on the stage of the cycle the appliance is at, to cause the pump or valve to dispense a chemical to the appliance appropriate for the stage of the cycle the appliance is at; and to control the quantity of chemical dispensed in dependence on the signal, or signals, received from the at least one meter.

On a commercial laundry washing machine there will typically be a plurality of such water inlets which are used to introduce water into the machine. Each of these may introduce water into the machine through an associated compartment, where an appropriate chemical may be manually added into the machine. Thus, where an external dosing system is not present, operation of an appropriate valve may be used to cause an appropriate chemical to be introduced into the drum of the machine with the water received through that valve.

Thus one inlet may typically be associated with a prewash and a compartment holding a quantity of detergent for a prewash, a second inlet may be associated with a main wash and a compartment holding a quantity of detergent for a main wash, with the first and second inlets possibly being opened simultaneously to fill the machine for the main wash and which inlets may again be opened to perform a first rinse or subsequent rinses. The third inlet will be opened, possibly together with the other inlets, to perform a final rinse, so that a fabric conditioner in the third compartment associated with that inlet may then be drawn into the appliance for that final rinse. Alternatively these multiple inlets may be simply present to speed up the filling of the machine. However, in either case, the operation of the inlets, or the quantity drawn through one or more inlets, will normally enable determination of the stage of the cycle the machine.

Thus, by individually monitoring the operation of these inlets on a machine, the stage of a cycle the machine is at may be determined. It may be preferable to meter separately the supply to each of the multiple water inlets of the washing machine, in order to determine the stage and cycle the machine is at. This same result can though be achieved by using a single meter to monitor the overall supply of water to the machine, with a plurality of flow detectors then being used to detect operation of the individual inlet valves, without having to supply a separate meter for each inlet.

For a laundry washing machine fabric detergent and fabric conditioner are preferably dispensed by the dosing system, with the system comprising at least two meters to be associated with respective water inlets of the laundry washing machine, the system comprising multiple pumps, or valves, arranged to respectively control the dispensing of the detergent and the fabric conditioner through respective inlets of the washing machine, wherein the quantity of each of the detergent and the fabric conditioner dispensed is determined by the control unit in dependence on a signal received from a respective meter associated with a respective inlet, indicative of the volume of water drawn into the machine for an associated stage of a cycle.

In an alternative embodiment, the chemical dosing system is arranged to determine the stage of a cycle an appliance is at from the volume of water drawn through the meter during one continuous intake of water, or within a predetermined period. This is particularly applicable in the case of commercial dishwashing machines, where there will normally only be a single water inlet, but where the quantities drawn in at any stage of a cycle will be fixed by the volumes of the machine, normally the volume of a wash tank and the volume of a boiler for rinse water that will end up in the wash tank. This is in contrast to a laundry washing machine, where the quantity of water, drawn in at any particular stage, may depend on the quantity and type of laundry within the machine.

In this embodiment, the control unit may thus preferably be arranged to determine the stage of a cycle an appliance is at by determining the volume of water drawn through the meter during one continuous intake of water, or within a predetermined period. The stage the machine is at being determined in dependence on whether the drawn quantity of water exceeds a predetermined volume, is less than a predetermined volume or is in a predetermined range. This may thus be determined by having a single meter arranged to be used with a machine, such as a dishwashing machine, having a single water inlet and wherein the control unit is arranged to monitor, via the meter, all quantities of water supplied to the water inlet.

The dosing system may further comprise a chemical detergent and a separate chemical rinse aid and pumps or valves arranged to dispense quantities of the detergent and of the rinse aid, in proportion to the volume of water supplied or being supplied to the appliance at a particular stage, as determined by the meter.

Preferably the control unit is arranged: to cause rinse aid, or rinse aid and detergent, to be dispensed to a dishwashing machine in proportion to the quantity of water supplied, if the quantity of water supplied at a particular stage does not exceed a predetermined quantity or is within a first predetermined range; and to cause detergent only to be added to the dishwashing machine in proportion to the quantity of water supplied at a particular stage if the quantity of water supplied at a particular stage exceeds a predetermined quantity or is within a second predetermined range, greater than the first predetermined range.

This is particularly applicable in the case of commercial dishwashing machines where, to initially fill the wash tank of a machine, (for example at the start of a shift or day), a large quantity of water is drawn into the wash tank to which a volume of detergent is to be added, proportional to the volume of water drawn. Subsequently all other water drawn into the machine, normally directly into a boiler, will be used for rinsing and thus will require rinse aid to be added, also normally directly into the boiler once this has been filled. This enables the boiler to heat the rinse water and rinse aid while the wash cycle is being performed.

The water in the boiler is then used to perform a rinse, with the used hot rinse water entering the wash tank (displacing some of the dirty wash water), for use in further wash cycles, but not rinse cycles. However, the degradation of a detergent in a previous wash cycle, together with new rinse water being drawn in and diluting the existing used water by displacing a proportion of this from the wash tank to a drain, will require new detergent to be added. Thus, both the quantity of rinse aid and quantity of detergent to be added each rinse cycle may be derived from the same metered volume of water received at the water inlet of the appliance for the rinse cycle.

The predetermined quantity may be between 5 and 50 litres, for a small commercial dish washer is likely to only typically draw 2.5 litres of water for a rinse cycle, whereas such a dishwashing machine may typically draw about 10 litres of water to initially fill a wash tank, which may for example be a once daily event.

The control unit may be arranged such that if the quantity of water supplied at a particular stage exceeds a predetermined value then no chemicals are dispensed.

The dishwashing machine may further comprises a water softening unit, which is arranged to draw a predetermined quantity of water, or arranged to draw water for a predetermined period of time, during a purge stage of a water softening cycle, which quantity exceeds a predetermined quantity or which period exceeds a predetermined period of time. Here the control unit is preferably arranged not to dispense either rinse aid or detergent when said predetermined quantity or predetermined period of time associated with the purge stage is exceeded, so as to ensure chemicals are is not added unnecessarily during purging of the water softener.

The dosing system may further comprise a water hardness sensor for detecting a parameter related to the hardness of water being supplied to the water inlet, the control unit being arranged to receive a signal from the water hardness sensor and modify the amount of chemical supplied in dependence on the detected parameter.

The control unit may also have an energy saving switch which, when activated, results in the control unit causing a greater proportion of chemical to be dispensed. Similarly, the control unit may have a water saving switch which, when activated, results in the control unit causing a greater proportion of chemical to be dispensed. Both of these features may avoid the need to establish any communication link between the control unit of the chemical dosing system and the appliance, instead permitting an operator to set the control unit to the same mode as the laundry washing machine or dishwashing machine, in order to increase the quantity or proportion of chemicals supplied when set in that mode.

It is necessary to increase the proportion of a detergent supplied in each of the above modes, for in a lower temperature energy saving mode the detergent will normally need to be stronger to achieve the same results and in a water saving mode the same quantity of chemical, such as a detergent, will be required to destroy the same amount of grease, for example, that may be present, even when less water is supplied.

In order to further automate the dosing system in accordance with the present invention, the dosing system may further comprise a reader arranged to read information from a chemical container relating to at least the type or concentration of the chemical within, wherein the control unit is arranged to control the quantity of chemical dispensed in dependence thereon. This enables the dosing system to ensure the correct dose of the correct concentration of chemical is supplied. (This may have applications other than to a dosing system in accordance with the present invention).

The above arrangement may permit a standard chemical of a standard concentration to be supplied where otherwise this would not be possible. For example, in most of Europe two grams of detergent per litre of water is a standard concentration and commercial washing machines are normally set up to accept chemicals on this basis, with suppliers supplying chemical at an appropriate concentration. However, in the Netherlands for example, the standard is one gram of detergent per litre of water, requiring that a chemical supplied to the Netherlands has to be twice as concentrated as a chemical supplied to the UK, for example.

A dosing system in accordance with this aspect of the invention may be arranged to only accept or operate with a chemical appropriately labelled and to then recognise that the chemical is of a particular concentration and dose accordingly. Alternatively, where no such information is detected by the reader, the dosing system may be arranged to dose on the basis that the concentration of the chemical is the standard concentration used in that country, for example one gram per litre in the Netherlands.

The reader may for example be arranged to read a radio frequency identification device (RFID) on or in the container, but many other types of identifier will be possible, for example a bar code on the container or supplied with the chemical.

Alternatively, the dosing system may further comprise a chemical for use in the appliance, the chemical containing an identifier, the system further comprising an identifier sensor arranged to identify the identifier and the chemical or concentration from the identifier and wherein the control unit is arranged to control the quantity of chemical dispensed in dependence thereon. The invention may also provide a chemical for use in such a system. This has the advantage that it is more difficult to tamper with such a system, for example by swapping chemicals from one container to another or by relabelling containers.

The control circuit may be arranged to monitor the number of wash cycles performed, or a period of time, and after that predetermined number of cycles, or period of time, determine that a maintenance cycle is to be performed and advise the operator or cause the machine to perform such a cycle, the control circuit being further arranged to cause to be dispensed during the maintenance cycle a quantity of a different chemical associated specifically with the maintenance cycle.

The above arrangement is advantageous because both dishwashing machines and laundry washing machines may need to be periodically subjected to a maintenance cycle. This is because in the case of a dishwashing machine, the machine and particularly the washer jets of a machine, may become scaled up over time. When this limescale starts to restrict the washer jets the cleaning performance may drop. Similarly in laundry machines, many cycles of low temperature washing may lead to unhygienic conditions inside the machine and the formation of biofilms. This aspect of the invention may ensure the requirement to perform a maintenance cycle is not overlooked and ensure the correct chemical is dispensed in such a maintenance cycle. In the above examples, the dishwashing machine would be dosed with an acidic descaler and the laundry machine with a disinfectant. This could be performed after a number of cycles or periodically, for example monthly, or whichever occurs first.

According to a second aspect of the invention there is provided a chemical dosing system comprising a dosing unit having a reader arranged to read information from a chemical container relating to at least the type or concentration of the chemical within, wherein a control unit of the dosing system is arranged to control the quantity of chemical dispensed in dependence thereon.

According to a third aspect of the present invention there is provided a container with a chemical therein to be dispensed to an appliance, the container comprising an identifier arranged to be read by a reader to identify a property relating to the concentration of that chemical.

According to a fourth aspect of the present invention there is provided a chemical for dispensing to a dishwashing machine or laundry washing machine, the chemical containing an identifier within the chemical by which the chemical and the concentration of the chemical may be identified. The identifier in the chemical may be one of an optical brightener, a coloured element or smart water.

According to a fifth aspect of the present invention there is provided method of dispensing a chemical to a dishwashing machine or laundry washing machine, the method comprising adding an identifier to the chemical by which the chemical and the concentration of the chemical may be identified and identifying the identifier and an associated concentration at a chemical dosing unit and controlling a dose of the chemical supplied in dependence thereon.

BRIEF DESCRIPTION OF DRAWINGS

Two embodiments of the present invention will now be described, by way of example only, with reference to the accompanying drawings, of which.

DETAILED DESCRIPTION

Figure 1:
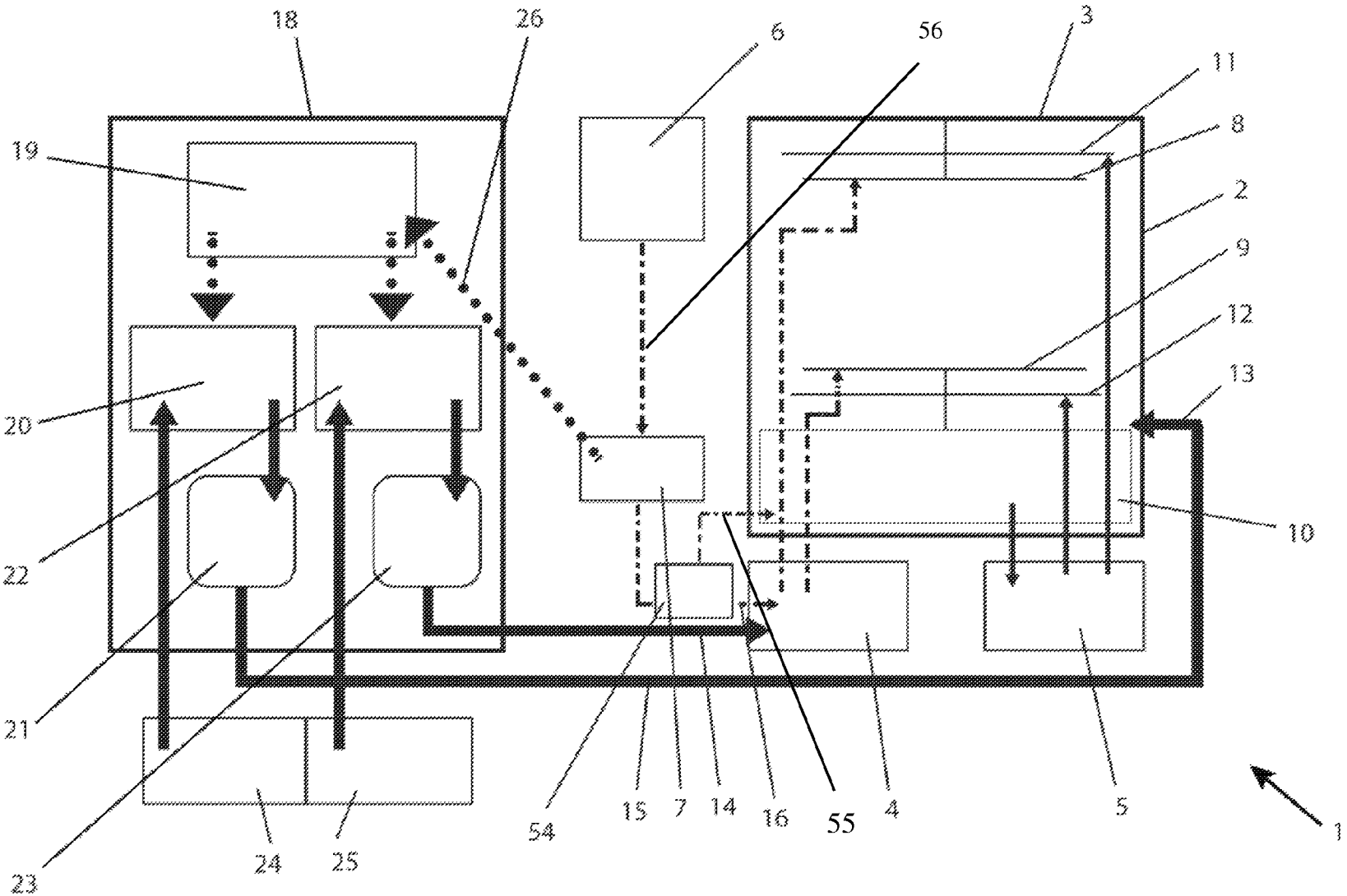
FIG. 1 schematically illustrates a dosing system in accordance with the present invention applied to a commercial dish washer.

Referring first to FIG. 1, a chemical dosing system in accordance with the present invention is indicated generally as 1 and, in the illustrated embodiment, this comprises a commercial dishwashing machine, indicated generally as 2, comprising a wash cabinet 3, a boiler 4, a wash pump 5 and a water softener 54.

The cabinet 3, boiler 4, wash pump 5 and water softener 54 will normally be housed in a common housing be housed within a common housing, not shown, with the cabinet 3, or they may be located separately from the cabinet 3. The boiler 4 receives clean water from a water supply 6 and heats this water which is then used to rinse the contents of the dishwashing machine via rinse arms 8 and 9.

The wash pump 5 is arranged to receive used wash water from a wash tank 10, formed by the bottom of the cabinet 3 and recirculates this via wash arms 11 and 12.

Although not shown, two drains are provided to wash tank 10, the first being in the form of an overflow, which maintains used wash water within the tank at a predetermined level and a drain by which the wash tank 10 can be drained periodically, for example at the end of the day. Additionally, a heating element, not shown, may be provided in the wash tank to heat the wash water, particularly if the machine has been inactive for a period of time. The cabinet 3 also has a detergent inlet, represented by arrow 13, by which detergent can be injected into the cabinet 3 in order to add detergent to the wash tank 10.

All the components described above of the dishwashing machine 2 are typical of most commercial dishwashing machines. Such a dishwashing machine 2 will additionally comprise control circuitry, not shown, for controlling the boiler 4, wash pump 5, a valve (not shown) for letting water from the water supply 6 into the boiler 4, for controlling any additional heating element within the wash tank 10, for controlling the water softener 54 and for controlling a final discharge from the machine, which may either be via a separate drain, not shown, or by a valve, not shown, diverting water from the wash pump 5 to the drain.

In use, the dishwashing machine 2 will be controlled in the normal manner by its own control circuitry, with approximately 10 litres of water being drawn in from the water supply 5 through the water softener 54 and into the wash tank 10, as indicated by the arrow 55, in order to provide an initial fill of the wash tank 10 for its first use, for example at the start of each day. The level of the wash tank may be monitored during this period by a sensor, not shown, in the dishwashing machine 2, to determine when this initial fill is complete.

A dose of detergent is then added, as explained below, at an inlet represented by the arrow 13, which dose is appropriate for a wash to be performed and the dishwashing machine can then be loaded with a first load of dirty dishes. The dishwashing machine is then activated and the wash pump 5 is energised for a period, which may typically be 90 seconds, with the water in the wash tank 10 being recycled by the wash pump 4 through the wash arms 11 and 12 in order to clean the dishes. The boiler 4 will already be filled with a quantity of water and rinse aid from the previous day, and this is heated from the time the machine is first switched on.

At the end of the wash stage of the cycle, a rinse stage commences, where heated water and rinse aid is then pumped from the boiler 4, by an additional pump (not shown), through the rinse arms 8 and 9 to rinse the dishes within the dishwashing machine 2. The additional water, in this example 2.5 litres, displaces water from the wash tank 10 to the drain.

Once the dishwashing machine 2 has been emptied, of the now clean dishes, and loaded with a second load of dirty dishes, the cycle is repeated, but this time there is no requirement to initially fill the wash tank 10. However the depleted detergent in the wash tank 10 is topped up and the boiler 4 is refilled, with both water obtained from the water supply 6 via the water softener 54 and with rinse aid received directly at a rinse aid inlet into the boiler 4, as represented by the arrow 14. The next wash stage then commences, with the water and rinse aid in the boiler 4 being heated during this process.

As previously mentioned, all of the components and operation described above are fairly standard to many commercial dishwashing machines.

In the chemical dosing system of FIG. 1, the dishwashing machine 2 receives rinse aid chemical at an inlet, as represented by the arrow 14, connected directly to an inlet on the boiler 4. Similarly the dishwashing machine 2 receives detergent along a line 15 connected to the detergent inlet, represented by arrow 13. On many machines, an inlet on the boiler 4 for rinse aid is provided as standard, but where such an inlet is not provided on the boiler 4, or at any other location on the dishwashing machine 2, or it is inconvenient to access the injection point, or it is more commercially viable to inject the rinse aid directly into the water supply, then the line for the rinse aid chemical 14 can instead be attached to a water supply line 16, extending between the water supply 6 and boiler 4.

Supply of rinse aid and detergent is controlled by a dosing unit 18 which comprises a control circuit 19, a detergent pump 20 and associated detergent valve 21, a rinse aid pump 22 and an associated rinse aid valve 23. The control circuit 19 controls the dispensing of detergent and rinse aid from respective containers 24 and 25 to the dishwashing machine 2.

A flow meter 7 detects and measures the flow of water along water supply line 56 and the control circuit 19 of dosing unit 18 uses this to control the detergent pump 20, associated valve 21, rinse aid pump 22 and associated valve 23 to provide a quantity of detergent and rinse aid at appropriate times and dependent on the volume of water drawn by the machine 2 for any particular stage of a wash cycle. The detergent pump 20 and rinse aid pump 22 may be peristaltic pumps or other pumps that provide a known displacement, or alternatively centrifugal pumps could be used with an additional meter to measure the quantity dispensed.

The dosing unit 18 can be used with most types of existing dishwashing machines 2 and requires no physical electrical connection to be made to the dishwashing machine 2, or the circuitry within that dishwashing machine 2, requiring only to be connected to the rinse aid inlet and a detergent inlet 13 on the dishwashing machine 2.

The dosing unit 18 may be installed with a new dishwashing machine 2 or subsequently installed to an existing dishwashing machine 2, requiring only the provision of the flow meter 7 in the water supply line 16.

The flow meter 7 provides a signal 26 to the control circuit 19, which signal 26 may be in the form of a series of pulses, each representing a known volume of water. When the control circuit 19 detects the flow of water along the water supply line 16 it measures this and if the flow stops before 7 litres of water have been measured, it determines that the boiler 4 has been replenished with water and then operates the rinse aid pump 22 and valve 23 to inject a desired quantity of rinse aid into the boiler 4 which is proportional to the volume of water measured. This is then heated and used to rinse the dishes in the normal manner.

At the same time the detergent pump 20 and associated valve 21 are also activated to inject an appropriate quantity of detergent, proportional to the volume of water measured, into the cabinet 3 via the detergent inlet, represented by the arrow 13, ready for the next cycle. Thus when the clean dishes are removed and the dishwashing machine 2 is reloaded, the water in the wash tank 10 will again contains the correct dose of detergent for the next wash cycle when the wash pump 5 is again energised.

If, when the dishwashing machine 2 is being initially filled from empty, a quantity of between 7 and 15 litres of water is drawn through the flow meter 7, then the control circuit 19 will cause detergent only to be dispensed and the volume of this will be dependent on the volume measured, ensuring the concentration of detergent in the initial fill of the wash tank 10 is correct.

Where, as in the illustrated embodiment, a water softener 54 is incorporated in the dishwashing machine 2, this will periodically perform a purge cycle. This will draw in excess of 15 litres of water into the machine through the common inlet and pass this directly from the water softener 54 to a drain, not shown. This quantity of water drawn into the machine 2 will be detected and measured by the meter 7. However, as this exceeds 15 litres, the control circuit 19 will ignore this, avoiding the unnecessary dispensing of detergent or rinse aid, which may not only be wasteful but could result in poor performance due to excessive frothing in the machine 2.

The dishwashing machine 2 may have a facility to perform a wash cycle at a lower temperature. Because detergents do not work as well at a lower temperature, the control circuit 19 has an operator input by which an operator may indicate that a low temperature wash cycle is to be performed, in response to which the control circuit will increase the dose of detergent for that cycle. The operator input may also be used to manually boost the proportion of detergent if required, for example when the dishwashing machine is loaded with dishes containing an unusually high quantity of grease, for example when cleaning cooking trays or pans.

Figure 2:
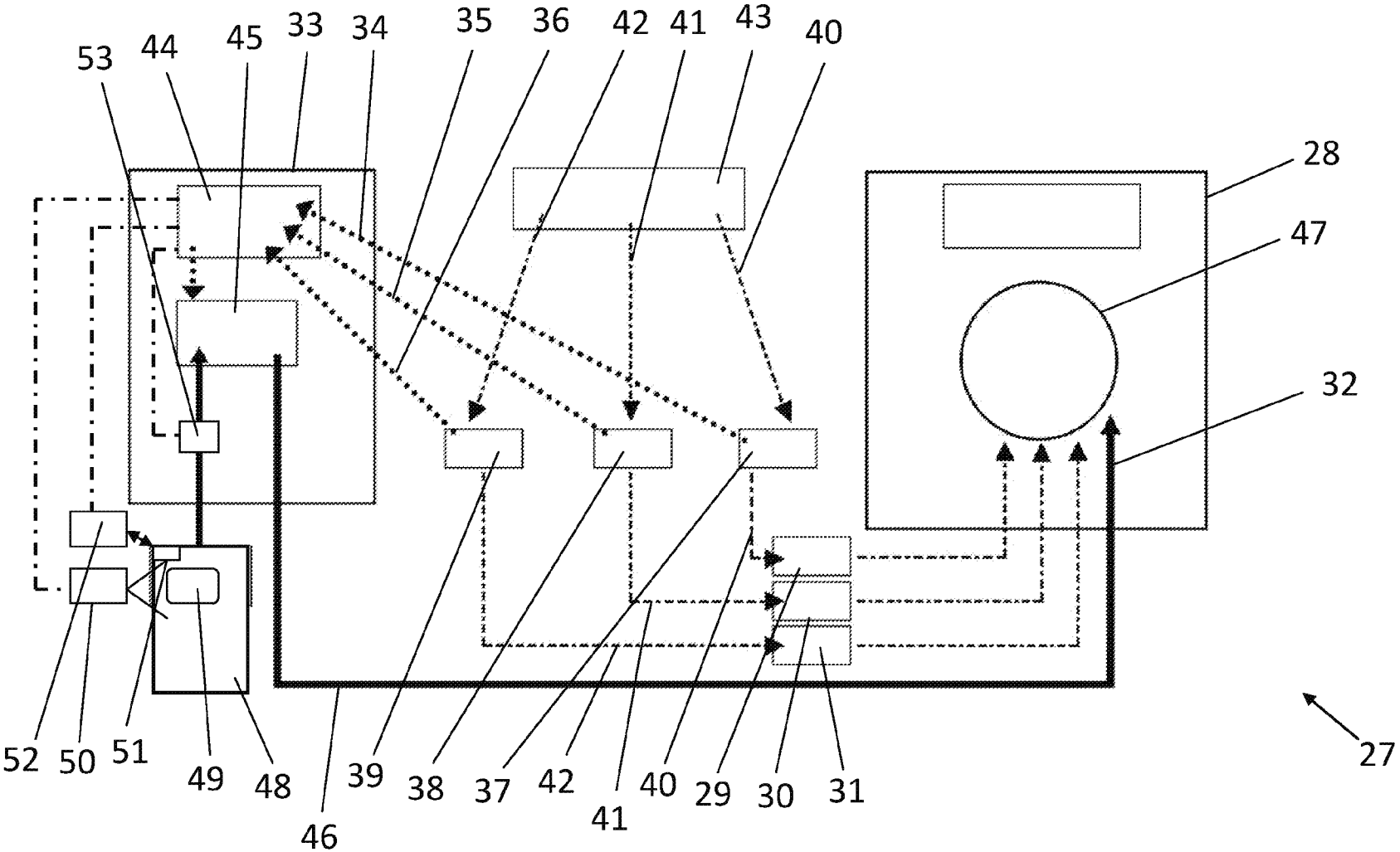
FIG. 2 illustrates a dosing system in accordance with the present invention applied to a commercial laundry washing machine.

Referring now to FIG. 2, this schematically illustrates a second embodiment of a chemical dosing system in accordance with the present invention and this is indicated generally as 27. The system 27 comprises a laundry washing machine 28 and, in the illustrated embodiment, this has three water inlet valves 29, 30 and 31 associated with it. The valves 29 to 31 may be located separately from the laundry machine 28, or they may be housed within the laundry machine 28.

The laundry machine 28 additionally has an inlet represented by arrow 32 for a detergent, but the machine 28 will normally have multiple inlets for the introduction of chemicals into a drum 47.

Although not shown, the laundry machine 28 will have an associated control circuit that controls the wash cycle and water inlet valves 29 to 31 in a conventional manner.

The water inlet valve 29 may be associated with a prewash, the water inlet valve 30 with a main wash and water inlet valve 31 may be associated with a final rinse, in which a fabric conditioner may be added to a drum 47 of the laundry machine 28. As is conventional, the purpose of the multiple valves 29 to 31 is to enable control of those valves to enable the administration of different chemicals at different parts of the cycle into the drum of the laundry machine 28, if these have been manually added by an operator into compartments associated with each valve, as previously discussed. However, many machines are arranged to also be used with an external dosing system, where chemicals, such as a detergents or fabric conditioners may be dispensed automatically from containers directly into the drum and for this reason the washing machine 28 has a number of inlets directly into the drum, as represented in FIG. 2 by the arrow 32.

In the embodiment illustrated in FIG. 2, a dosing unit 33 is provided, which may be the same as that described with reference to FIG. 1. The dosing unit 33 does not need to be electrically connected or receive any controls signals from the laundry machine 28. Instead, the dosing unit 33 receives signals 34, 35 and 36 from respective flow meters 37, 38 and 39, which are positioned in respective water supply lines 40, 41 and 42, each extending between water supply 43 and a respective one of the water inlet valves 29 to 31. The signals 34 to 36 may each be in the form of pulses, with each pulse representing a volume of water passing through a respective flow meter 37 to 39.

The signals 34 to 36 are received by a control circuit 44 within dosing unit 33, which control circuit 44 controls a number of pumps 45, only one of which is shown, each associated with a respective chemical within a respective container 48, only one of which is shown, for pumping that chemical from the container 48 along a respective line 46, only one of which is shown, to a respective inlet on the laundry machine 28, represented by arrow 32.

In operation, the control circuit 44 identifies from respective signals 34, 35 and 36 the stage of the cycle the laundry machine is at and causes to be dispensed an appropriate quantity, of an appropriate chemical, which quantity is proportional to the volume of water drawn through the respective meter 37, 38 or 39.

In all the above embodiments, an additional water hardness meter may be included in a water supply line and a signal from this may be received by the control circuit and used to modify the quantity of a chemical independence of the hardness of the water detected.

In the two embodiments previously described, it has been assumed that the chemicals being dispensed will be of a standard concentration or a concentration known by an engineer, who may set the dosing unit 18 of FIG. 1, or 33 of FIG. 2 accordingly. However, in either embodiment this may be automated by the dosing unit being able to identify the chemical. This optional feature, which may have applications other than to dosing systems of the type illustrated in FIGS. 1 and 2 will now be described with reference to FIG. 2.

Referring to FIG. 2, a container 48 is illustrated for a chemical to be dispensed. This container 48 has either a device 49, such as a bar code or similar on the packaging, which can be read by an optical reader 50 or a radio frequency identification device (RFID) 51 which can be read by an RFID reader 52, either of which can be used to identify to the control circuit 44 both the chemical and the concentration of the chemical. The control circuit 44 can then use this to adjust the quantity of chemical dispensed accordingly. Additionally it may be arranged to prevent the dispensing of a chemical unless the chemical is in a container with an appropriate device or RFID.

As an alternative to the above the chemical in the container may have an identifier in it, which may be a trace element such as an optical brightener, a coloured element or smart water, which can be detected by a detector 53 of FIG. 2, as the chemical is drawn from the container 48. This can also then be used to identify the chemical and the concentration of the chemical and again prevent dispensing if the chemical does not contain an appropriate identifier. A number of variations of an identifier may be used in order to identify different chemical types and or concentrations. Alternatively properties of the chemical itself may be identified by a physical parameter, such as absorbing one or more light wavelengths, emitting light on one or more wavelengths after photoexcitation, conductivity or turbidity. Or it could be a chemical identifier, such as determining the presence of a specific chemical or ion. Or the chemical could be identified using ratios of two or more of the above parameters.

Two embodiments of the present invention have been described by way of example only with reference to a chemical dosing system for a dishwashing machine and a chemical dosing system for a laundry machine. However, chemical dosing systems in accordance with the present invention, as defined by the following claims, may have other applications and in addition many variations with embodiments shown will be apparent to those skilled in the art without departing from the scope of the invention as defined by the following claims.

The invention claimed is:

1. A chemical dosing system comprising an external chemical dosing apparatus and an appliance embodied as a dishwashing machine, wherein the chemical dosing apparatus is arranged to be located external to the appliance, the apparatus comprising:

a meter arranged to be located external to the appliance and arranged to determine a volume of water supplied, or a rate at which water is being supplied, to the appliance via the water inlet;

a pump or valve arranged to be located external to the appliance for dispensing a volume of chemical to the appliance; and a control unit arranged to be located external to the appliance, the control unit being arranged to receive a signal from the meter and to determine from said signal a stage in a cycle the appliance is at and to control the pump or valve in dependence thereon, to cause the pump or valve to dispense said chemical to the appliance, said chemical being appropriate for the stage of the cycle the appliance is at and to control the quantity of said chemical dispensed, in dependence on the volume of water supplied via the water inlet to the appliance at that stage of the cycle, wherein the chemical dosing apparatus further comprises a chemical detergent as said chemical, a separate chemical rinse aid, and a further pump or valve configured to dispense a quantity of the rinse aid, in proportion to the volume of water supplied or being supplied to the appliance at a particular stage, as determined by the meter, wherein the dishwashing machine comprises: a boiler; a chemical inlet directly into the boiler through which rinse aid is dispensed into the boiler by the control unit after the boiler has been filled with water; a wash tank; a chemical inlet into the wash tank through which detergent is dispensed by the control unit directly into the wash tank, and a single water inlet, wherein the control unit is configured to monitor via the meter all quantities of water supplied to the inlet and to determine the stage of a cycle an appliance is at by determining the volume of water drawn through the inlet for that particular stage of the cycle, during one continuous intake of water, or within a predetermined period, and to dispense an appropriate quantity of rinse aid or detergent for that stage of the cycle, wherein the system is configured:

in an initial fill stage, to draw water into the wash tank through the water inlet to fill the wash tank;

in a first wash stage, to circulate water from the wash tank so as to clean dishes within the dishwashing machine;

in a first rinse stage, to pump a quantity of water from the boiler so as to rinse dishes within the dishwashing machine and displace an equal quantity of water from the wash tank, and to subsequently draw an equal quantity of water into the boiler through the water inlet, said quantity not exceeding a predetermined quantity or in a first predetermined range;

in a second wash stage subsequent to the first wash stage and the first rinse stage, to circulate water from the wash tank so as to clean dishes within the dishwashing machine; and in a second rinse stage subsequent to the second wash stage, to pump a quantity of water from the boiler so as to rinse dishes within the dishwashing machine and displace an equal quantity of water from the wash tank, and to subsequently draw an equal quantity of water into the boiler through the water inlet, said quantity not exceeding the predetermined quantity or in the first predetermined range;

and wherein the control unit is configured:

to cause rinse aid and detergent to be dispensed to said dishwashing machine in proportion to a quantity of water supplied through the water inlet if the quantity of water supplied at a particular stage does not exceed a predetermined quantity or is within the first predetermined range, wherein rinse aid is dispensed into the boiler and detergent is dispensed into the wash tank; and to cause detergent only to be added to said dishwashing machine in proportion to the quantity of water supplied through the water inlet, if the quantity of water supplied at a particular stage exceeds a predetermined quantity or is within a second predetermined range, greater than the first predetermined range, and wherein the control unit is configured such that if the quantity of water supplied through the water inlet at a particular stage exceeds a predetermined value then no chemicals are dispensed.

2. A chemical dosing system as claimed in claim 1, wherein the control unit is arranged to determine the stage of a cycle an appliance is at in dependence on whether the volume of water drawn through the meter during one continuous intake of water, or within a predetermined period, exceeds a predetermined volume, is less than a predetermined volume or is in a predetermined range.

3. A chemical dosing system as claimed in claim 1, wherein all water supplied to the appliance is supplied through the water inlet, and wherein the control unit is arranged to monitor, via the meter, all quantities of water supplied to the water inlet.

4. A chemical dosing system as claimed in claim 1, arranged to dispense said detergent directly to a first chemical inlet of a dishwashing machine connected to a wash tank of said dishwashing machine and to dispense said rinse aid directly to a second chemical inlet of said dishwashing machine connected to a boiler of said dishwashing machine, which chemical inlets are separate to the water inlet of said dishwashing machine.

5. A chemical dosing system as claimed in claim 1, wherein the control unit is arranged to operate without any electrical or other control signal passing either way between the appliance and the control unit.

6. A chemical dosing system as claimed in claim 1, further comprising a water hardness sensor for detecting a parameter related to hardness of water being supplied to the water inlet, the control unit being arranged to receive a signal from the water hardness sensor and modify the quantity of chemical dispensed to the appliance in dependence on the detected parameter.

7. A chemical dosing system as claimed in claim 1, wherein the control unit has an "Energy Saving" switch which, when activated, results in the control unit causing a greater proportion of chemical to be dispensed to the appliance.

8. A chemical dosing system as claimed in claim 1, wherein the control unit has a "Water Saving" switch which, when activated, results in the control unit altering the proportion of chemical to be dispensed.

9. A chemical dosing system as claimed in claim 1, further comprising a reader arranged to read information from a chemical container relating to at least one of a type or concentration of the chemical within the chemical container, wherein the control unit is arranged to control the quantity of chemical dispensed to the appliance in dependence on a signal obtained from the reader.

10. A chemical dosing system as claimed in claim 9, wherein the reader is arranged to read a radio frequency identification device (RFID) on, or in, the chemical container.

11. A chemical dosing system as claimed in claim 1, further comprising a sensor arranged to identify a chemical and/or concentration of a chemical by analysis of the chemical or an identifier in the chemical, wherein the control unit is arranged to control the quantity of chemical dispensed to the appliance in dependence on a signal obtained from the sensor.

12. A chemical dosing system as claimed in claim 1, wherein the control unit monitors the number of wash cycles performed, or a period of time, and after a predetermined number of cycles, or period of time, determines that a maintenance cycle is to be performed and advises an operator or causes the appliance to perform such a cycle, wherein the control unit is then arranged to cause to be dispensed to said appliance during that maintenance cycle a quantity of a different chemical which is specifically associated with the maintenance cycle.

* * * * *